United States Patent [19]

Townsend et al.

[11] Patent Number: 4,949,626

[45] Date of Patent: Aug. 21, 1990

[54] PROTECTIVE SYSTEM

[75] Inventors: Douglas W. Townsend; Duane O. Terry, both of Glen Burnie, Md.

[73] Assignee: Radon Appliances, Inc., Glen Burnie, Md.

[21] Appl. No.: 334,764

[22] Filed: Apr. 10, 1989

Related U.S. Application Data

[63] Continuation of Ser. No. 13,950, Feb. 12, 1987, abandoned.

[51] Int. Cl.[5] ..... F24F 7/06; F24F 11/00

[52] U.S. Cl. ..... 98/42.02; 52/169.5; 52/302; 52/742; 98/115.1; 137/565

[58] Field of Search ..... 52/169.5, 302, 303, 52/742, 173 R; 98/42.02, 42.06, 115.1; 137/392, 429, 565; 417/36, 38, 40

[56] References Cited

U.S. PATENT DOCUMENTS

| | | | |
|---|---|---|---|
| 349,735 | 9/1886 | Nicaise | 52/169.5 |
| 1,984,513 | 12/1934 | Angelus et al. | 98/115.1 X |
| 3,017,722 | 1/1962 | Smith | 52/169.5 |
| 4,348,158 | 9/1982 | Wood | 417/40 |
| 4,371,383 | 2/1983 | Rost | 55/169 |
| 4,620,398 | 11/1986 | Wallin | 52/169.1 |

FOREIGN PATENT DOCUMENTS

| | | | |
|---|---|---|---|
| 144250 | 3/1931 | Fed. Rep. of Germany | 98/42.02 |
| 772276 | 4/1957 | United Kingdom | 98/115.1 |

OTHER PUBLICATIONS

"Radon Reduction Techniques for Detached Houses", *Technical Guidance*, U. S. Environmental Protection Agency, EPA/625/5-86/019, Jun. 1986.

Anthony V. Nero, Jr., "The Indoor Radon Story", *Technology Review*, Massachusetts Institute of Technology, Jan. 1986, pp. 28-31 and 36-40.

*Primary Examiner*—Harold Joyce

*Attorney, Agent, or Firm*—Morton J. Rosenberg; David I. Klein

[57] ABSTRACT

A protective system (10) is provided for preventing deleterious gases from entering the internal atmosphere (34) of a building structure (12) derived from surrounding ground environments (14 and 18). An enclosure (24) is mounted above a sump (26) containing a sump pump (30) for discharging liquid (32) to an external environment (22) when taken with respect to building structure (12). Mounted adjacent to the enclosure (24) is a fan mechanism (52) for drawing a partial vacuum in an enclosure chamber (28 and 28'). The fan mechanism (52) is in fluid communication with a gas discharge pipe (58) for passing or displacing contaminated gas into the external atmosphere (22). Radon contaminated gas passes through perforated drainage pipes (48) into sump (26) and due to the negative pressure gradient created by fan mechanism (52), radon contaminated gas is displaced through gas discharge pipe (58) to the external atmosphere (22). The enclosure (24) and couplings thereto are formed in substantially airtight relation and thus, the contaminated gas being drawn from enclosure chambers (28 and 28') is not directed into the building structure internal atmosphere (34), but displaced directly to the external atmosphere (22).

15 Claims, 2 Drawing Sheets

PROTECTIVE SYSTEM

This is a continuation of co-pending application Ser. No. 013,950, filed on 2/12/87, now abandoned.

BACKGROUND OF THE INVENTION

1. Field of the Invention

This invention pertains to a method and system for maintaining the internal atmosphere of a building structure free of contaminated gaseous products. In particular, this invention relates to a system and method for passing radon contaminated gaseous products directly to the external environment of a building structure. More in particular, this invention relates to a system and method where a substantially airtight enclosure covers a sump as well as a sump pump and a water discharge pipe and is mounted within a building structure. Further, this invention directs itself to a system and method whereby a negative pressure gradient is provided when taken with respect to surrounding ground and enclosure chambers to draw radon contaminated gas into the enclosure chambers. More in particular, this invention directs itself to a system and method where radon contaminated gases forming in an enclosure chamber which is in substantially airtight sealing engagement with respect to an internal building structure is drawn out of the enclosure chamber through a discharge pipe to the external atmosphere. This invention directs itself to a system and method whereby a partial vacuum is drawn within a sump and radon contaminated air is drawn from the soil surrounding a building structure to prevent the radon contaminated air from entering into the building structure through cracks and porosity in the ground slabs and structure walls forming portions of the foundation of the building structure.

2. Prior Art

Radon contamination has become a field of interest in recent years. Generally, high levels of radiation contamination have been found in a number of geographical areas. In some cases, high levels of radon contamination in dwellings have been found to exceed those allowed in uranium mines. In the protection of dwellings, a number of ventilation processes have been installed in building structures. Of major interest in prior art systems is the sealing of cracks in ground slabs and in underground walls. Manifolds have been suggested to be built on top of or at the base of below ground walls to trap the air drawn through the walls from the soil. The contaminated air is then drawn by a fan to the external environment.

The best prior art known to the Applicants are U.S. Pat. Nos. 349,735; 3,426,487; 3,017,722; and, 3,668,829. However, none of these prior art systems direct themselves to removal of radon gas contaminated air from building structures, and further do not direct themselves to the concept of providing substantially airtight enclosures over a sump, sump pump and water discharge pipe to draw a vacuum in a sump enclosure for removal of the contaminated air through exhaust fans to an external environment.

In prior art systems such as those shown in U.S. Pat. No. 349,735, there are provided draining cellars where the bottom of the cellar is graded in a manner to carry off water by drain pipes or sewers to a well through one main sewer in the center of the cellar. The sewers are open at the bottom to allow the water to come up into the sewers from the bottom of the cellar and a brick lining around the sidewalls is placed in a manner to leave a vacuum between it and the cellar wall. However, there is no discharge of gaseous products external to the building structure as is necessary to the subject concept.

In other prior art systems, such as that shown in U.S. Pat. No. 3,426,487, basement drainage systems are provided where a motor driven pump is coupled to a conduit for positively removing water. The control for the motor intermittently removes the water from the wall or floor structure and the motor is controlled responsive to external conditions. Once again, such prior art systems do not direct themselves to passage of radon contaminated gas from external ground environments through a sump and a substantially airtight enclosure for exhaust to the external atmosphere.

SUMMARY OF THE INVENTION

A protective system for preventing deleterious gases from entering internal a building structure from a surrounding ground environment. The protective system includes an enclosure mechanism for a well formed in the ground environment defining an enclosure chamber. The enclosure mechanism is secured to and is internal the building structure. The protective system further includes a mechanism for developing a pressure gradient between the surrounding ground environment and the enclosure chamber for drawing the deleterious gases into the enclosure chamber.

DESCRIPTION OF THE PREFERRED EMBODIMENTS

Figure 1:
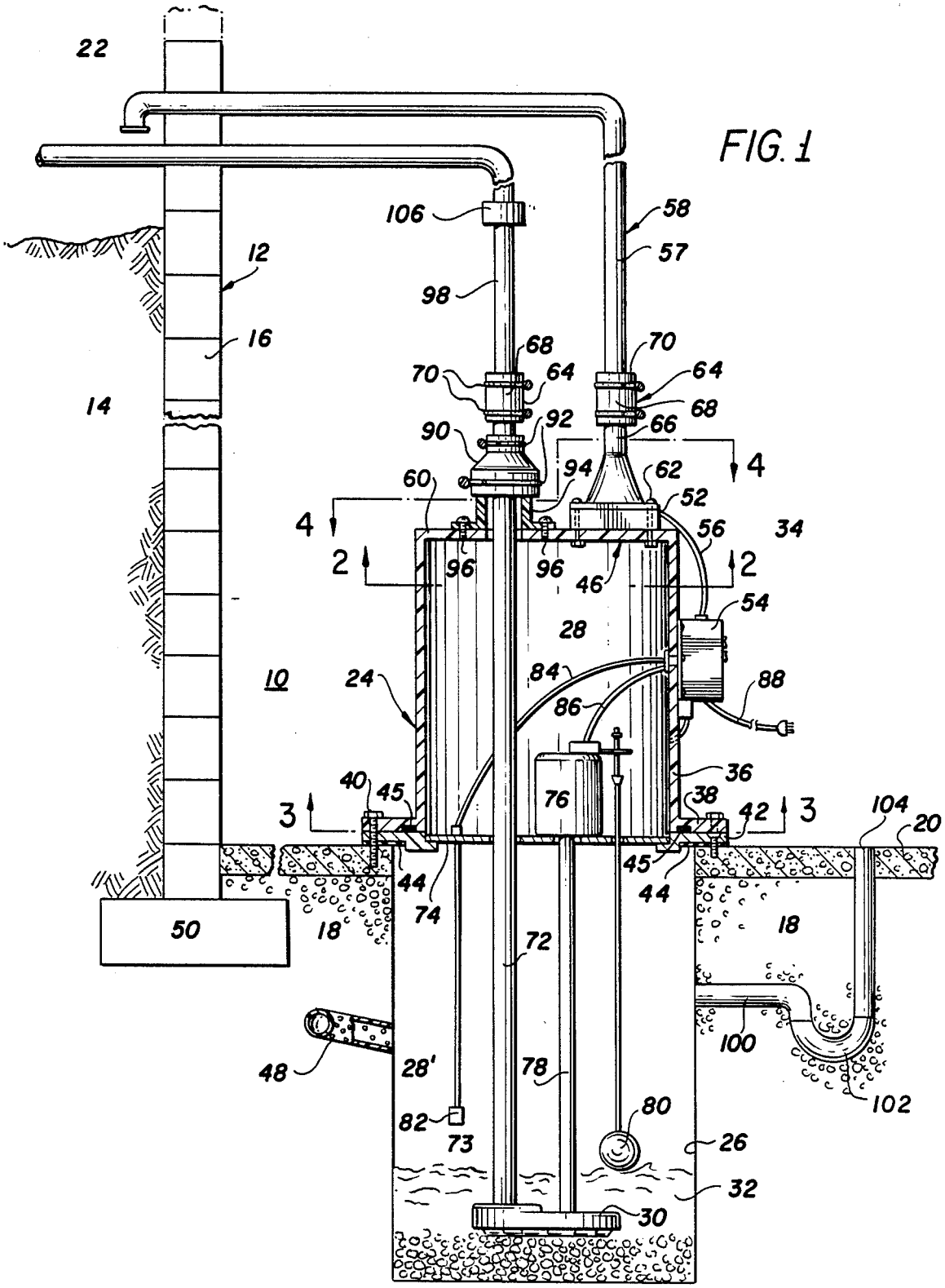
FIG. 1 is a cut-away elevational view of the protective system showing such mounted over a sump with exhaust to the external atmosphere.
Figure 2:
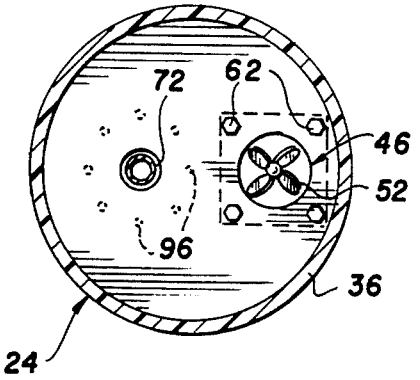
FIG. 2 is a sectional view of the exhaust portion of the protective system taken along the Section Line 2—2 of FIG. 1.
Figure 3:
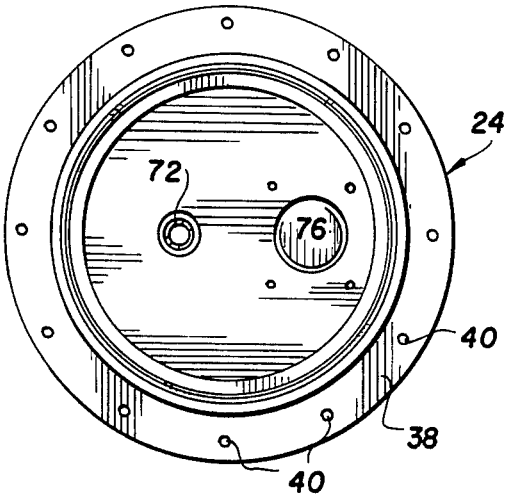
FIG. 3 is a sectional view of a substantially airtight enclosure mounted over a sump taken along the Section Line 3—3 of FIG. 1; and, FIG. 4 is a sectional view of the exhaust portion of the protective system taken along the Section Line 4—4 of FIG. 1.

Referring now to FIGS. 1–4, there is shown protective system 10 as well as a method for preventing deleterious gases from entering internal building structure 12 from surrounding ground environment 14 adjacent structural walls 16 of building structure 12, as well as ground environment 18 shown adjacent floor slabs 20, commonly a part of the structural system of standard building structures 12.

In overall concept, as will be seen in following paragraphs, protective system 10 and the associated method of implementation is directed to isolating the internal atmosphere of building structures 12 from entrance of deleterious gases formed in the surrounding ground environment 14 and 18. In particular, protective system 10 is directed to insulating building structures 12 from the entrance of radon gas which is a chemically inert gas forming naturally in ground environments 14 and 18 from spontaneous radioactive decay of radium 226 formed in itself by the spontaneous radioactive decay of uranium 238. The half-life of radon gas approximates 3.8 days. However, it has been found that numerous dwellings around the World are contaminated by radon gas and other radioactive decay elements. Such contamination has been found to be a serious problem and disadvantageous effects to the health of persons living in the dwellings has been prognosticated.

As previously stated, the half-life of radon gases approximates 3.8 days, however, this is sufficient time for such radon gas to be drawn internal to building structure 12 due to the fact that there is a reduced pressure internal to structures 12 when compared to surrounding external atmospheres 22.

The particular amount of radon gas entering building structures 12 is dependent upon a plurality of parameters. Obviously, of major importance, is the amount of uranium 238 and other elements contained in the surrounding ground environments 14 and 18. With relation to the amount of uranium 238, the permeability to gas flow under slight pressure gradients is of importance. Where there is the high permeability, the resistance to the radon gas flow is less and the radon gas flow can then seek openings internal to building structures 12 through cracks, breaks, or other discontinuities in floor slabs 20, structural walls 16, or like structural members.

In order to provide for radon gas flow internal to building structures 12, there must be a negative pressure gradient between ground environment 14 and 18 and the internal environment of building structure 12. A number of factors provide for the naturally occurring negative pressure gradient such as the heated air internal to building structures 12 being warmer and thus, lighter than the air external to building structures 12.

Drafts caused by burning fuel internal to structures 12 also provide for the negative pressure gradient as previously discussed. Additionally, users have been insulating and caulking cracks in various structural members of structures 12 which causes once again a higher negative pressure gradient. A few factors which increase the negative pressure gradient directs itself to the height of building structures 12; increases in the temperature differences between external atmospheres 22 and internal atmospheres of building structures 12; external wind velocity; and of course, the amount of uranium 238 and other radioactive elements in surrounding soils or ground environments 14 and 18.

Referring now to FIG. 1, protective system 10 is shown to include enclosure 24 which is mounted over well 26 formed within ground environment 18 below floor slabs 20. As will be seen in following paragraphs, enclosure 24 forms enclosure chamber 28 which may include enclosure chamber 28' formed by well 26. Enclosure 24 is secured to and mounted internal building structure 12 as will be further detailed.

Well 26 may be a sump which includes sump pump 30 which is used for removal of liquid 32 contained within sump or well 26.

Enclosure 24 includes a housing structure which is secured to floor slabs 20 of building structure 12 as shown in FIG. 1. Housing 24 is secured to floor member 20 in a fluid sealing relation to provide a substantially airtight enclosure chamber 28 when taken with respect to the internal atmosphere of environment 34 of building structure 12. Housing 24 is shown to include housing sidewalls 36 and extending around a lower portion thereof is housing lower flange 38 which is secured to floor slab 20. Housing bolts 40 are seen to pass through housing lower flange 38 and cooperating rigid flange 42 which substantially interfaces with floor slabs 20 through sealant members 44 which may be a flexible seal to further isolate enclosure chamber 28 from building internal environment 34. Alternatively, rigid flange 42 may be cemented, adhesively secured, or otherwise fixedly secured to floor slab 20 in a manner to isolate enclosure chamber 28 from building internal environment 34. Additionally, in order to still further isolate the environments of chamber 28 and internal environment 34, O-rings 44 may be utilized as shown in FIG. 1 between housing lower flange 38 and cooperating flange 42 to increase the overall isolation efficiency of the system.

Substantially airtight enclosure or housing 24 as shown in FIG. 1 may be formed of a metal composition, plastic, or some like material composition not important to the inventive concept as herein described, with the exception that such provide a substantially impervious boundary to prevent air from building internal environment from leaking into chamber 28 and 28' and being exhausted from building structure 12.

Protective system 10 further includes pressure gradient mechanism 46 for developing a negative pressure gradient between surrounding ground environment 18 and enclosure chamber 28, as well as 28' for drawing deleterious gases into enclosure chambers 28' and 28 from ground environment 18. As will be seen, deleterious gases are then exhausted to external atmosphere 22 without entrance thereof into building structure internal environment 34. Pressure gradient mechanism 46 has as its objectives and purposes to develop a lower pressure in enclosure chambers 28' and 28 than that provided in ground environment 18. In this manner, there is a natural flow of deleterious gases into chambers 28' and 28.

In order to provide such flow, there are shown the usual perforated drainage pipes 48 which pass into sump 26. Pipes 48 are generally placed inside footings 50 of structural walls 16 and around the edge of a ground slab. Perforated drainage pipes 48 may be surrounded by gravel to allow entrance of liquid and radon contaminated air drawn through soil 18 by reduced pressure developed internal enclosures 28 and 28' as well as building structure internal environments 34 through natural processes.

Pressure gradient mechanism 46 includes a mechanism for exhausting deleterious gas external to building structure 12. As is clearly seen in FIG. 2, the mechanism for exhausting deleterious gases includes blower or fan 52 which is in fluid communication with enclosure chamber 28 and external environment 22 of building structure 12. Fan 52 is adapted to exhaust air from enclosure 24 to external atmosphere 22. Fan 52 may be positionally located as clearly shown in FIGS. 1 and 2, or alternatively may be located internal enclosure 24 or even within gas discharge pipe 58.

Figure 4:
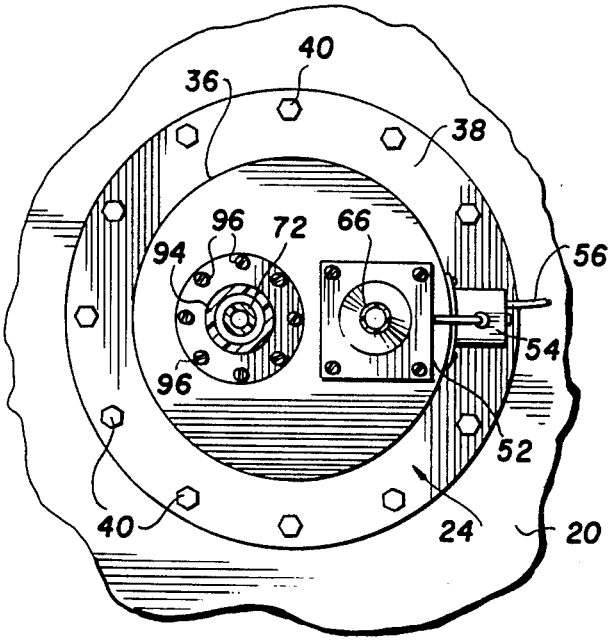

Fan 52 is operated from control box 54 to drive a fan motor 53, shown in FIG. 4, through electrical lead 56. Fan 52 is coupled to enclosure 24 in sealing relation thereto and draws gases from enclosure chamber 28 to external environment 22. Exhaust pipe 58 is coupled to enclosure 24 and contains fan 52 with exhaust pipe 58 passing external to building structure 12 through structural wall 16, as is shown in FIG. 1. Fan 52 is secured in airtight relation to upper wall 60 of enclosure or housing 24 through fan bolts 62 or some like coupling, not important to the inventive concept as herein described, with the exception that fan or blower 52 be coupled in substantially airtight relation to upper wall 60 to maintain isolation between enclosure chamber 28 and building internal environment 34. Gas discharge pipe 58 may be formed in a sectional manner having upper section 57 and lower section 66 which contains fan mechanism 52. In this case, upper gas discharge pipe 57 may be coupled to gas discharge pipe lower section 66 through flexible union seal 64 shown in FIG. 1. This type of flexible union seal is well-known in the art and is mounted between the pipes exhausting air from the fan 52 and may be simply in the form of a flexible hose 68 mounted to each of sections 57 and 66 by standard hose clamps 70. It is to be understood that both gas discharge pipe 58 and water discharge pipe 72 may be installed with a pair of flexible union seals 64 to aid in simplicity of installation and servicing of enclosure 24.

What has now been shown in prior paragraphs is a portion of protective system 10 which provides for a well or sump 26 within which there is created a lower pressure than found in surrounding ground 18. Deleterious gases as well as water may pass into well or sump 26 and then be drawn from enclosure chambers 28 and 2840 through gas discharge pipes 66 and 57 by a blower mechanism 52 and then discharged external to building structure 12 into external atmosphere 22. In this manner, the deleterious gases such as radon pass from the surrounding soil and ground 18 and 14 of building structure 12 through an open passage through the internal environment 34 of building 12 but isolated therefrom until it may be disposed of external building structure 12.

Referring to FIG. 1, well 26 may be a sump containing water discharge pipe 72 and such may include sump pump 30 maintained within enclosure chamber 28'. Although housing or enclosure 24 may be formed over any well 26 formed in ground environment 18, it is most commonly and usefully mounted over and in alignment with sump 26.

In this connection, sump pump 30 would include the usual liquid discharge pipe 72 passing in a vertical direction through support plate 74 which is seen to be mounted on shoulders of cooperating flanges 42. Support plate 74 may be formed of metal, wood, plastic, or some like composition not important to the inventive concept as herein described, with the exception that such have the structural integrity to maintain the components thereon without structural collapse.

Sump pump 30 is driven by standard sump pump motor 76 through drive shaft 78. Sump pump motor 76 may be activated by float bulb 80 or other type water or liquid level detector and control device which activates sump pump motor 76 when liquid level 32 reaches a predetermined height. There may be included high liquid depth sensor 82 to give an indication of high liquid level within sump 26 upon failure of sump pump 30 in some operating mode. Obviously, sensor 82 and sump pump motor 76 are coupled to control box 54 by respective leads 84 and 86. Control box 54 is electrically coupled to a standard outlet through control box outlet line 88.

Alternatively, an immersed sump pump may be used in sump 26 or a well type pump may be located in liquid discharge pipe 72 as is well known in the art. Additionally, it is important to locationally position liquid level detector 82 below drainage pipe 48 in order to maintain pipe 48 relatively dry in order to provide a manifold around structure 12 in order to allow radon to be easily drawn into sump 26.

Liquid discharge pipe 72 is coupled in airtight relation to enclosure or housing 24 by flexible stepped pipe union 90 which forms a fluid seal between liquid discharge pipe 72 from sump pump 30 and enclosure or housing 24.

Flexible stepped pipe union 90 may be coupled by hose clamp 92 to fitting 94 which is shown bolted by fitting bolts 96 to upper wall 60 of enclosure 24. As is seen in FIG. 1, fitting 94 may essentially be a cylindrical member interfaced with flexible stepped pipe union 90 through gripping contact by hose clamps 92. Fitting 94 is shown coupled by way of a lower flange which is bolted through fitting bolts 96 to enclosure or housing 24. The important consideration being that liquid discharge pipe 72 be maintained in fluid tight relation within enclosure 24 to maintain isolation of gases contained within enclosure chambers 28 and 28' from internal structure environment 34. Alternatively, pipe fitting 94 may be a substantially straight section of pipe cemented or formed as a portion of upper wall 60 of enclosure 24.

Liquid discharge pipe 72 may be unitary in nature, however, in normal operating conditions for simplicity of construction, such discharge pipe 72 may include a lower discharge pipe section 73 and an upper section 98 which is coupled to discharge pipe lower section 73 through flexible union seal 64 and associated hose clamps 70 as was provided and described for gas discharge pipe 58. As can be seen in FIG. 1, upper liquid discharge pipe section 98 passes through structural wall 16 of building structure 12 for discharge of liquid 32 external to building structure 12.

Referring to FIG. 1, as is the usual case, where sump pump 30 is operative within sump 26, there is provided drain pipe 100 passing from floor drain 104 to sump enclosure 28'. Drain pipes 100 are commonly used to accept liquid passing from standard appliances internal to structure 12 which allow drainage directly into sump 26. Additionally, in drain pipe 100, there is provided water trap 102 which allows for fan or blower 52 to create a partial vacuum or negative pressure gradient within enclosure chambers 28 and 28'. Check valve 106 may be inserted into upper liquid discharge pipe 98 as shown and such prevents air from external environment 22 from flowing back into sump or well 26 when sump 26 is devoid of liquid 32. Check valve 106 is common in the art and generally utilized in environments, as herein provided, and may be a poppet, ball check valve, or some like type of one-way valve mechanism.

Control box 54 mounted to sidewalls 36 of housing 24 may contain standard electrical circuitry and mechanisms to provide indication or alarms showing malfunction of sump pump 30 or blower and fan mechanism 52. Additionally, such may provide for alarms directed to water height as indicated by sensor 82 or an overheated sump pump motor 76. Such may also contain solenoid or fuse mechanisms to interrupt power to motors when some type of fault is sensed. Such control box 54 is not part of the subject invention concept as herein described, but directs itself to standard indication and alarm type mechanisms which may be used in conjunction with protective system 10 as herein described.

Protective system 10 defines a method of preventing deleterious gases from entering internal building structure 12 from surrounding ground environments 14 and 18 as has previously been described. The method of preventing such deleterious gases from entering internal building structure 12 includes establishing enclosure or housing 24 internal building structure 12 over well or sump 26 formed in ground environment 18 which then defines an enclosure chamber 28 and 28'.

The step of establishing enclosure or housing 24 internal building structure 12 includes the step of establishing and providing a substantially fluid tight housing 24 over well or sump 26. Enclosure 24 is fluid sealingly engaged to an internal floor slab 20 of structure 12 by bolting or cementing housing lower flanges 38 to floor members 20. Additionally, sealing engagement is provided by flexible sealants 44 which may in some applications be an adhesive, and O-rings 45 as shown in FIG. 1 extending around a peripheral boundary of sidewalls 36 of enclosure 24.

The overall method further includes the step of developing a pressure gradient between surrounding ground environment 18 and enclosure chamber 28 and 28'. This step of developing a pressure gradient which is a negative pressure gradient when taken with respect to the fact that the pressure within chambers 28 and 28' are lower than the pressure external to such chambers in ground environment 18 provides for drawing the deleterious gases from ground environment 18 into enclosure chambers 28 and 28'.

The step of drawing the deleterious gases into enclosures 28 and 28' includes the step of mounting a blower or fan 52 adjacent, or within enclosure 24, as well as possibly along discharge pipe 58 and in fluid communication with enclosure chamber 28. In the step of mounting fan 52, such includes the step of fluidly isolating fan 52 from the internal environment 34 of the structure 12. The step of mounting the blower 52 further includes the step of fluidly coupling or maintaining in fluid communication the fan 52 to building structure external environment 22 in order that deleterious gases may be displaced thereto.

Further, deleterious gases are exhausted from enclosure chambers 28 and 28' to external environment 22 of building structure 12. Such gases are displaced through pipe sections 57 and 66 to cause a flow of deleterious gases from ground environment 18 into chambers 28 and 28' and then through but isolated from internal environment 34 of building structure 12 to external environment 22.

In actual tests, when traps 102 and 106 were in operation, a partial vacuum of up to 4.0 inches of water was created by fan mechanism 52. The 4.0 inches of water is more than two orders of magnitude greater than the maximum pressure difference which is usually created internal/external building structures 12 due to the parameters of temperature differences, wind pressure, and drafts from combustion of fuels. Fan 52 has been found to create an acceptable partial vacuum within chambers 28 and 28' as well as creating a partial vacuum in soil environment 18 under floor slabs 20 and within soil 14 surrounding building structure 12. This partial vacuum creates an acceptable negative pressure gradient in the soil to permit flow of deleterious gases internal chambers 28 and 28' and then external building structure 12. A preferred range of pressure difference has been found between the approximate range of 0.1 inches to 1.0 inches of water head, however, acceptable pressure differences have been provided between the approximating range of 0.01 inches to 4.0 inches of water head.

The lower absolute pressure created by fan 52 in soil environment 18 causes air to flow through cracks in ground slabs 20 and below ground walls 16 from inside structure 12 into sump drainage pipes 48 and sump or wells 26.

During general operation of sump pump 30, air flow may be reversed through fan 52 so that partial vacuum in enclosures 28 and 28' does not increase and water is not displaced out of traps 102 and 106.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A protective system for preventing deleterious gases from entering a building structure from a surrounding ground environment, comprising:

(a) enclosure means mounted over a sump pit enclosing a sump pump and forming a substantially air tight enclosure, said enclosure means including (1) a first member fixedly secured to a concrete floor slab and mounted at least partially around a periphery of said sump pit, and, (2) a second member releasably secured to said first member for providing a temporary opening when said second member is removed from said first member, through which said sump pump may be removed from said sump pit without removal of said first member from said concrete floor slab;

(b) at least one conduit fitting defining a stub pipe fixedly secured to an outer surface of said second member and in axial alignment with an opening formed through a wall of said second member defining a stub through passage;

(c) means for removal of air from within said air tight enclosure and discharge external to said building structure;

(d) means for discharging liquid from said air tight enclosure to an external environment of said building structure, said means for discharging liquid including a liquid discharge pipe extending from said sump pit at least through said stub pipe through passage in a co-axial manner; and, (e) means for securing said stub pipe to said liquid discharge pipe in a substantially air tight manner.

2. The protective system as recited in claim 1 wherein said means for securing said stub pipe includes a flexible pipe union mounted over at least a portion of an outer wall of said liquid discharge pipe and an outer wall of said stub pipe.

3. The protective system as recited in claim 2 where said means for securing said stub pipe includes at least a pair of securable hose clamps for securing said flexible union respectively to said liquid discharge pipe and said stub pipe.

4. The protective system as recited in claim 2 where said flexible pipe union defines an elastomeric reducing coupling member having a first end internal diameter wall secured to an outer surface of said stub pipe and a second end internal diameter wall secured to an outer surface of said liquid discharge pipe.

5. The protective system as recited in claim 1 where said means for removal of air includes at least one gas discharge pipe fixedly secured to a wall of said second member in axial alignment with an opening formed through said wall of said second member for passage of air from internal said sump pit to said gas discharge pipe.

6. The protective system as recited in claim 5 where said means for removal of air includes:

(a) an upper gas discharge pipe; and, (b) a lower gas discharge pipe in coaxial and abutting relation with said upper gas discharge pipe, said lower gas discharge pipe being releasably secured to said upper gas discharge pipe in substantially air-tight securement.

7. The protective system as recited in claim 6 wherein abutting ends of said upper and lower gas discharge pipes include:

(a) a flexible hose coupling passing over abutting end sections of said upper and lower gas discharge pipes; and, (b) a pair of hose clamps for releasably securing said flexible hose coupling to outer walls of said abutting end sections of said upper and lower gas discharge pipes.

8. The protective system as recited in claim 5 where said means for removal of includes blower means in fluid communication with said sump pit and an external environment of said building structure.

9. The protective system as recited in claim 8 where said blower means includes an exhaust fan in co-axial alignment with said gas discharge pipe for removal of gases from internal an enclosure formed by said second member and said sump pit, said exhaust fan being coupled to said gas discharge pipe in substantially air-tight securement.

10. The protective system as recited in claim 1 wherein said deleterious gases are substantially composed of radon.

11. The protective system as recited in claim 1 where said second member includes a cover member releasably secured to said first member.

12. The protective system as recited in claim 1 where said first member is a flange member adhesively sealed to said concrete floor slab in fixed securement.

13. A protective system for preventing deleterious gases from entering a building structure from a surrounding ground environment, comprising:

(a) enclosure means mounted over a sump pit enclosing a sump pump and forming a substantially air tight enclosure, said enclosure means including (1) a first member fixedly secured to a concrete floor slab and mounted at lest partially around a periphery of said sump pit, and, (2) a second member releasably secured to said first member for providing a temporary opening when said second member is removed from said first member, through which said sump pump may be removed from said sump pit without removal of said first member from said concrete floor slab;

(b) at least one conduit fitting defining a stub pipe fixedly secured to an outer surface of said second member and in axial alignment with an opening formed through a wall of said second member defining a stub through passage;

(c) means for removal of air from within said air tight enclosure and discharge external to said building structure;

(d) means for discharging liquid from said air tight enclosure to an external environment of said building structure, said means for discharging liquid including (1) a liquid discharge pipe extending from said sump pit at least through said stub pipe through passage in a co-axial manner, (2) at least a lower liquid discharge pipe extending from within said sump pit and through a wall of said second member defining an end section of said lower liquid discharge pipe, and (3) at least an upper liquid discharge pipe in coaxial alignment with said lower liquid discharge pipe and flexibly secured in substantially air-tight coupling to said lower liquid discharge pipe.

14. The protective system as recited in claim 13 including a flexible hose member mounted over abutting end sections of said upper and lower liquid discharge pipes.

15. The protective system as recited in claim 14 including a pair of releasable hose clamps mounted over said flexible hose member for clamping said hose member to respective adjacent sections of said lower and upper liquid discharge pipes.

* * * * *